US005167093A

United States Patent [19]

Hamilton

[11] Patent Number: 5,167,093

[45] Date of Patent: Dec. 1, 1992

[54] PARKING BARRIER

[76] Inventor: David M. Hamilton, P.O. Box 1329, Robbinsville, N.C. 28771

[21] Appl. No.: 738,267

[22] Filed: Jul. 31, 1991

[51] Int. Cl.[5] ..... E01F 13/00

[52] U.S. Cl. ..... 49/35; 49/49; 49/131; 49/394; 404/6; 428/99; 428/122

[58] Field of Search ..... 428/99, 122; 49/35, 49/49, 131, 394; 404/6

[56] References Cited

U.S. PATENT DOCUMENTS

| | | | |
|---|---|---|---|
| 2,627,920 | 2/1953 | Barlow | 161/15 |
| 2,913,906 | 11/1959 | Sinclair | 74/2 |
| 3,061,960 | 11/1962 | Dull | 39/5 |
| 3,417,508 | 12/1968 | Sprung | 49/35 |
| 3,660,935 | 5/1972 | Boots | 49/35 |
| 3,688,439 | 9/1972 | Doxsee | 49/35 |
| 3,698,135 | 10/1972 | Boots et al. | 49/35 |
| 3,750,331 | 8/1973 | Renaux | 49/35 |
| 3,838,760 | 10/1974 | Selby, Jr. | 194/1 R |
| 3,849,936 | 11/1974 | Geraci | 49/35 |
| 3,913,264 | 10/1975 | Kohen | 49/49 |
| 3,925,929 | 12/1975 | Montgomery | 49/35 |
| 3,956,853 | 5/1976 | Montgomery | 49/35 |
| 4,050,190 | 9/1977 | Mazzono | 49/35 |
| 4,137,662 | 2/1979 | Baumer | 40/612 |
| 4,190,379 | 2/1980 | Toro Sosa et al. | 404/6 |
| 4,641,459 | 2/1987 | Mesa | 49/35 |
| 4,713,910 | 12/1987 | Quante | 49/49 |
| 4,858,382 | 8/1989 | Ellgass | 49/35 |

*Primary Examiner*—Alexander S. Thomas

*Attorney, Agent, or Firm*—Bell, Seltzer, Park & Gibson

[57] ABSTRACT

A parking barrier apparatus for restricting ingress into and egress from a parking space is disclosed. The parking barrier includes an elongate, substantially planar base member adapted to be secured onto the ground of a parking space. An elongate carrying cover of is pivotally connected to the base member and movable from a first, upright position into a second, prone position. The carrying cover includes a substantially U-configured channel portion that is inverted and covers a portion of the base member when the carrying cover is upright. A barrier member is secured to the elongate cover and extends outward therefrom. A lock mechanism is secured within the channel of the carrying cover for engaging and locking the cover in the first, raised position. The lock mechanism remains substantially enclosed by the carrying cover and base member when the carrying cover is upright to prevent tampering with the lock mechanism.

17 Claims, 3 Drawing Sheets

PARKING BARRIER

FIELD OF THE INVENTION

This invention relates to a parking barrier apparatus for restricting ingress into and egress from a parking space.

BACKGROUND OF THE INVENTION

In larger cities, parking spaces are a premium, and often private parking spaces adjacent commercial buildings are expensive. Additionally, once a vehicle is parked in the space, it is desirable to ensure that thieves cannot remove the vehicle from the parking space. Various parking barriers and obstruction posts have been proposed for restricting ingress into and egress from a parking space to ensure that one who has paid for a private parking space, will have access to that space.

Many of the proposals are large, complex apparatus, expensive to manufacture, and not designed for easy access into the parking space even when the barrier is in a lowered position. Thus, cars that have a frame low to the ground cannot readily pass over the barrier. Additionally, some of the barriers are secured onto the ground by lag bolts or other means that are not enclosed by the barrier. Because the lag bolts or other securing means is not protected, the bolts and barrier can be readily removed.

Other barriers have large, upstanding posts or other means that pivot downward to allow ingress into a parking space. A long rod extends through the post or other means to engage a lower member for locking the post in an upright position. These also are usually complex and thieves may more easily tamper with the long locking mechanism.

One barrier proposal, U.S. Pat. No. 4,050,190 to Mazzone, does not incorporate a long rod but discloses a pivotable barrier frame, which is journaled through a base. The frame carries a bolt that may be lowered into the base. Although this barrier design is simple and lies prone on the ground when lowered to facilitate vehicle ingress into and egress from the parking space, the locking mechanism is not protected by the base or barrier frame and thieves easily can cut the exposed center bolt.

SUMMARY OF THE INVENTION

It is therefor an object of the present invention to provide a parking barrier apparatus for restricting ingress into and egress from a parking space and which includes a locking mechanism substantially enclosed by the apparatus when in an upright position.

It is another object of the present invention to provide a parking barrier apparatus for restricting ingress into and egress from a parking space and which includes a barrier member movable from an upright position in which vehicles are restricted from passing over the barrier and a prone position in which the barrier member is lowered and extends substantially prone on the ground for allowing vehicles to pass over.

It is another object of the present invention to provide a parking barrier apparatus for restricting ingress into and egress from a parking space and in which many of the internal components of the apparatus are protected from tampering when the parking barrier is in an upright position.

In accordance with the present invention, the parking barrier apparatus includes an elongate, substantially planar base member having a top surface that is adapted to be secured onto the ground of a parking space. An elongate, carrying cover is pivotally connected to the planar base member and is movable from a first, upright position in which the carrying cover substantially covers the top surface of the planar base member and into a second position in which the carrying cover is pivoted away from the base member. The carrying cover includes a U-configured channel portion which is inverted over the base member when the carrying cover is in an upright position. A barrier member is secured to the elongate carrying cover and extends outward therefrom. The barrier member extends vertically upward when the carrying cover is positioned in the first, upright position for preventing a vehicle from entering or exiting the parking space. The barrier member extends laterally with the base member and prone to the ground on which the base member is secured when the carrying cover is pivoted into the second position.

Lock means is secured within the channel of the carrying cover for selectively engaging and locking the carrying cover in the first, raised position, wherein said lock means remains substantially enclosed by the carrying cover and base member to prevent tampering to the lock means when the barrier is raised.

In a preferred embodiment, the elongate carrying member has two elongate and substantially parallel leg members to form an elongate, box channel. One of the legs is pivotally connected at the base member. In an upright position the two leg members extend substantially perpendicular to the base member and the top plate member is positioned over the base member so that the top surface of the base member is substantially enclosed by the carrying cover to prevent access thereto.

The lock means comprises a deadbolt mechanism secured within the channel between the two legs of the carrying cover. An upright latch plate is secured onto the base member and receives the bolt of the deadbolt mechanism when the carrying cover and barrier member are locked in an upright position. The locking mechanism includes a key opening positioned on the surface opposing the channel for allowing locking operation of the deadbolt when the carrying channel is positioned in the upright position. Endwalls are secured to the end portions of the carrying cover for preventing access into the channel when the carrying cover is in an upright position. A spring clip is carried within the channel of the carrying cover and is received over clip receiving member secured onto the base member. The spring clip engages the clip receiving member when the carrying cover and barrier member are in an upright position.

DETAILED DESCRIPTION OF THE PREFERRED EMBODIMENT

Figure 1:
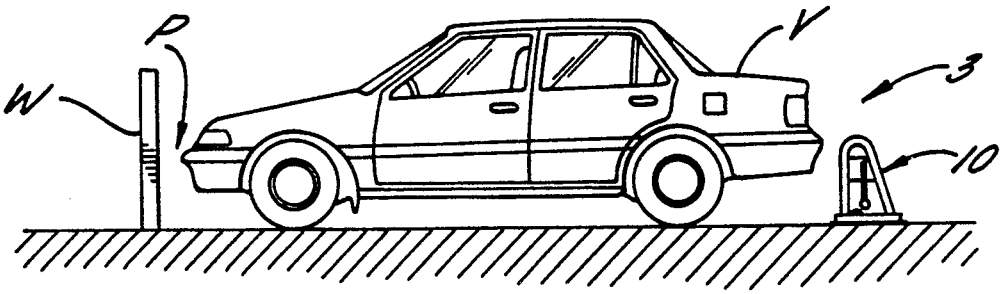
FIG. 1 is a side elevational view showing a vehicle in a parking space and the parking barrier in accordance with the present invention that is positioned upright.
Figure 2:
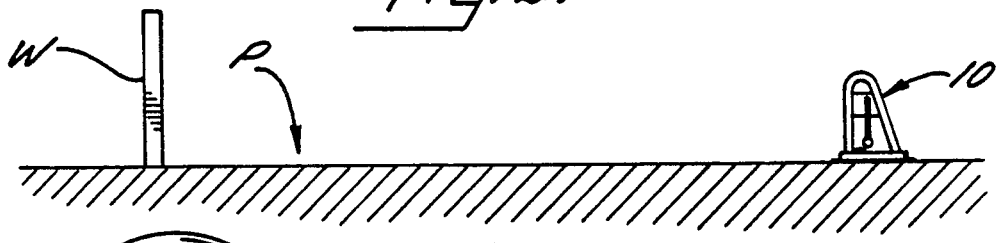
FIG. 2 is a view similar to FIG. 1, but showing the vehicle removed from the parking space.

Referring now to the drawings, and more particularly to FIG. 1, there is disclosed a parking barrier apparatus, indicated generally at 10, secured in a parking space, labeled P in FIGS. 1 and 2 and positioned upright for restricting ingress into and egret from the parking space. The parking barrier 10 is suited for use in parking garages and other similar locations in which the vehicle v is prevented from entering into the parking space or exiting same when the parking barrier is in an upright position as when a wall is positioned on the other side of the vehicle V from the parking barrier 10.

Figure 5:
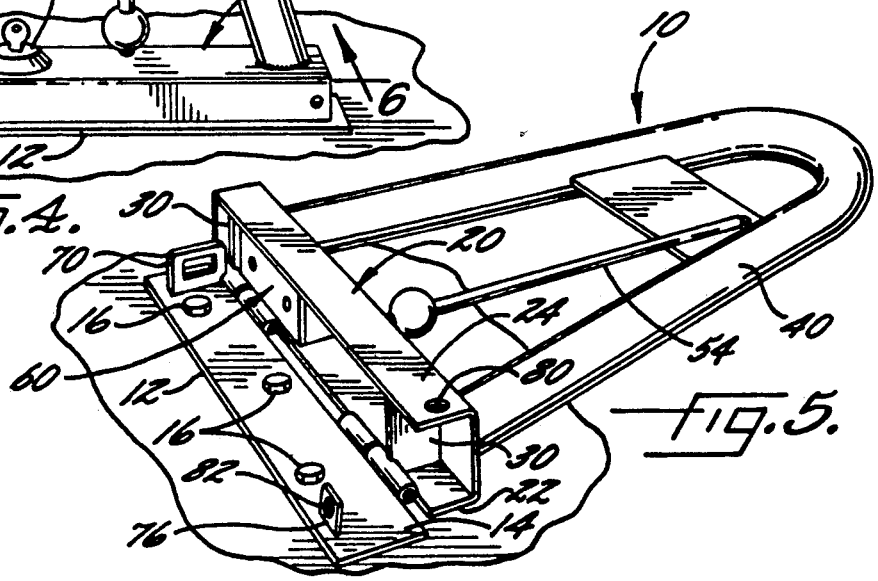
FIG. 5 is an isometric view of the parking barrier in a lowered position.
Figures 6, 7, 8, 9:
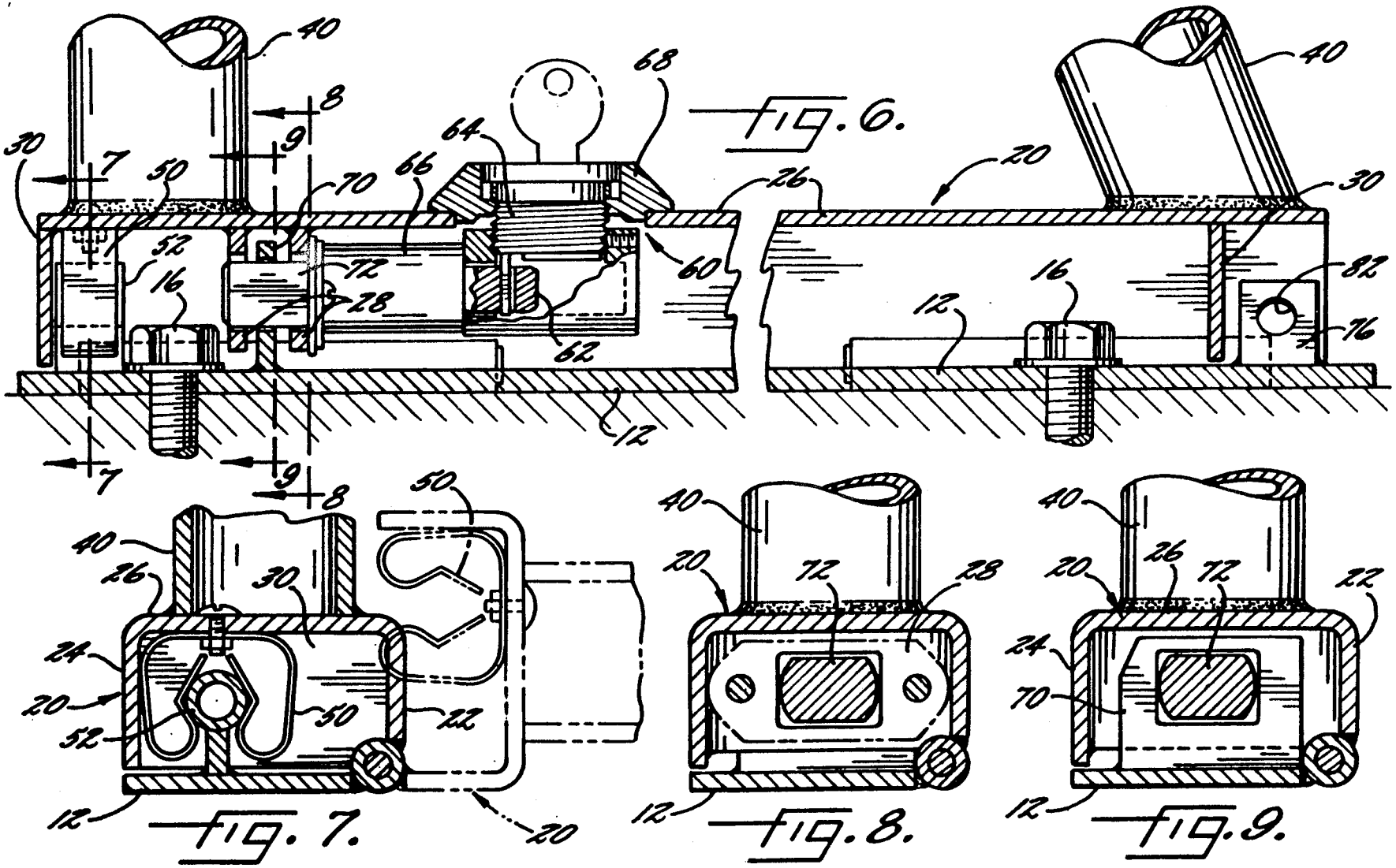
FIG. 6 is sectional view taken along line 6—6 of FIG. 4.
FIG. 7 is a sectional view taken along line 7—7 of FIG. 6.
FIG. 8 is a sectional view taken along line 8—8 of FIG. 6.
FIG. 9 is a sectional view taken along line 9—9 of FIG. 6.

The parking barrier includes an elongated, substantially planer base member 12 having a top surface 14 (FIG. 5). Preferably, the base member 12 is formed of a rectangular plate of steel and includes holes in which lag bolts 16 or other means are inserted through the top surface 14 to secure the base member onto the ground of the parking space. An elongate carrying cover, indicated generally at 20 is pivotally connected to the base member 12 along one edge thereof. The elongate carrying cover 20 has two elongate and substantially parallel leg members 23, 24 and an elongate transverse top plate member 26, which connects the two parallel leg members to form an elongate, box channel 28 (FIGS. 7-9). The formed box channel 28 preferably is approximately the length of the base member 12.

Figure 10:
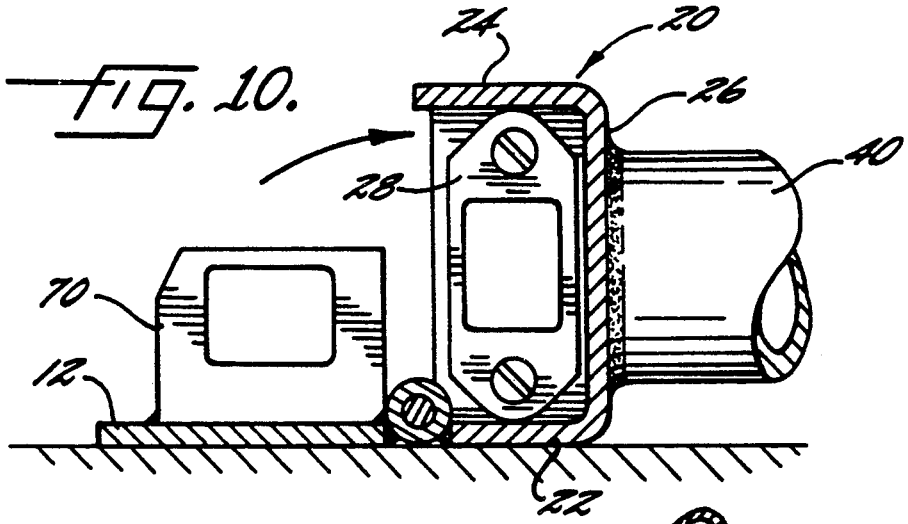
FIG. 10 is a sectional view similar to FIG. 8 and showing the barrier member lowered.
Figure 12:
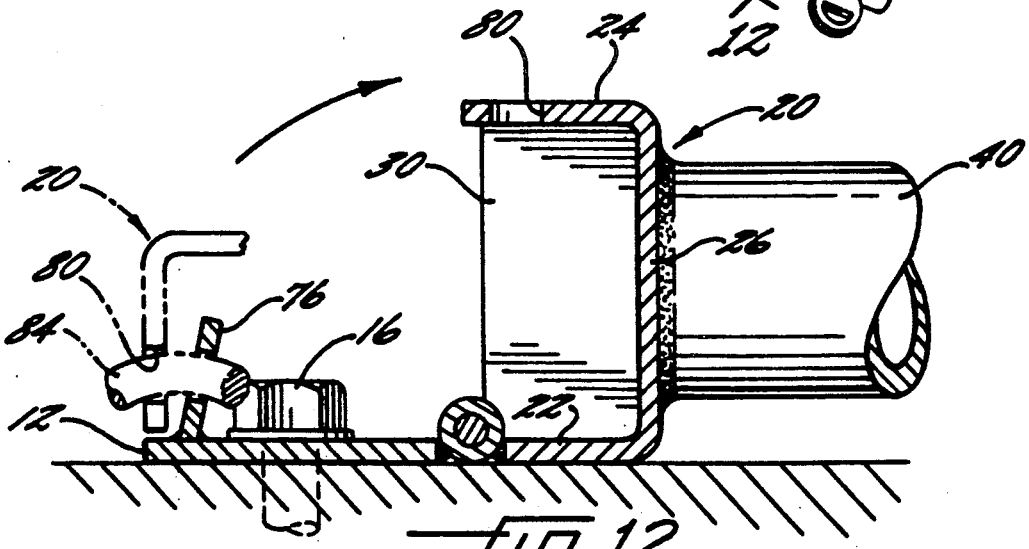
FIG. 12 is a sectional view taken along line 12—12 of FIG. 11.

One of the leg members is pivotally connected along its lower edge to the base member. The carrying cover 20 is pivotally movable into a first, upright position in which the two leg members extend substantially perpendicular to the base member. In this position, the top plate member 26 is positioned over the base member 12 so that the top surface 14 of the base member 12 substantially enclosed by the carrying cover to prevent access to the interior of the channel 28 and the top surface of the base member. When the carry cover 20 is pivoted, it is moved into a second position in which the carrying cover 20 is pivoted away from the base member 12 and the side of the leg connected to the base member rests prone on the ground (FIGS. 10 and 12). The legs 22, 24 of the carrying cover 20 are spaced from each other no greater than about 4 inches and the base member 12 is only slightly wider than that distance between the legs. In the illustrated embodiment, the legs are spaced about 2 inches apart. The legs are no greater than about 3 inches and preferably about 1.675 inches apart. End walls 30 are secured to the end portions of the carrying cover 20 for preventing access into the channel 28 when the carrying cover 20 is in an upright position.

Figure 3:
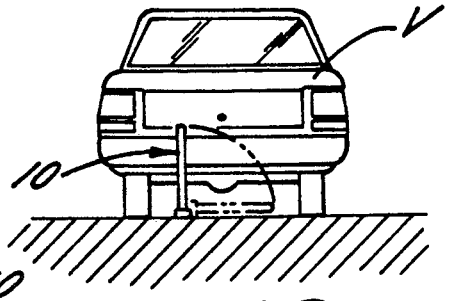
FIG. 3 is an end view looking in the direction of arrow 3 in FIG. 1 and showing the lowered and upright positions of the parking barrier.

A barrier member 40 is secured to the surface of the top plate member 26 opposite the channel 28 and extends outward therefrom substantially perpendicular thereto. The barrier member may range in height as long as the barrier member prevents a car from passing thereover. In the illustrated embodiment, the barrier member is about 22 inches high. When the carrying cover 20 is positioned in the upright position, the barrier member 40 extends substantially vertical to prevent a vehicle V from entering or exiting the parking space. When the carrying cover is pivoted, the barrier member 40 extends substantially lateral with the base member 12 and prone to the ground on which the base member is secured (FIGS. 3 and 5).

Figure 4:
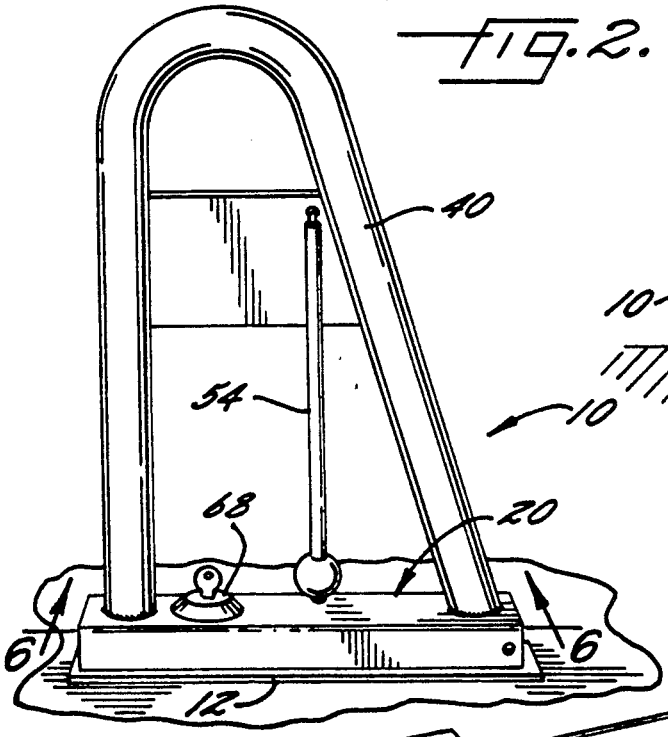
FIG. 4 is an isometric view of the parking barrier in an upright position.

The barrier member 40 preferably comprises a tubular member of triangular configuration for imparting strength and resisting deformation when a vehicle moves into the upright barrier member 40. As shown in FIGS. 1 and 4, one leg of the formed triangle is substantially vertical. The parking barrier is secured onto the ground in a position in which the vertical leg is positioned adjacent the vehicle positioned in the parking space. The other leg extends downward at an angle to form a stronger structure to resist deformation when a vehicle is backed into the parking barrier 10.

A spring clip 50 is carried within the channel 28 of the carrying cover 20, and a clip receiving member 52 is secured onto the base member. When the parking barrier 10 is in an upright position, the spring clip 50 engages the clip receiving member 52 and retains the barrier member 40 in the vertical position. A lifting rod 54 is secured onto the barrier member 40 for facilitating manual raising of the barrier member. The rod may be fixed relative to the barrier member or secured by a string to allow more flexible movement of the lifting rod 54.

Lock means, indicated generally at 60, is secured within the channel 28 of the carrying cover 20 for selectively engaging and locking the cover in the upright position. As illustrated in FIG. 6, the preferred lock means is a dead bolt mechanism secured within the channel, and the deadbolt mechanism remains substantially enclosed by the carrying cover 20 and base member 12 to prevent tampering to the lock when the barrier member 40 is raised and upright.

The lock mechanism includes a cylinder 62, cylinder housing 64 and bolt housing 60. The cylinder 62 extends upward through an opening in the carrying cover 20 and has a key opening 68 positioned on the surface opposing the channel for allowing access to the key opening when the carrying channel is positioned in the upright position for allowing locking operating of the dead bolt mechanism. An upright latch plate 70 is secured onto the base member 12 (FIG. 5). The latch plate 70 receives the bolt 72 of the dead bolt mechanism when the carrying cover 20 and barrier member 40 are locked in an upright position and the lock mechanism 60 is actuated.

Figure 11:
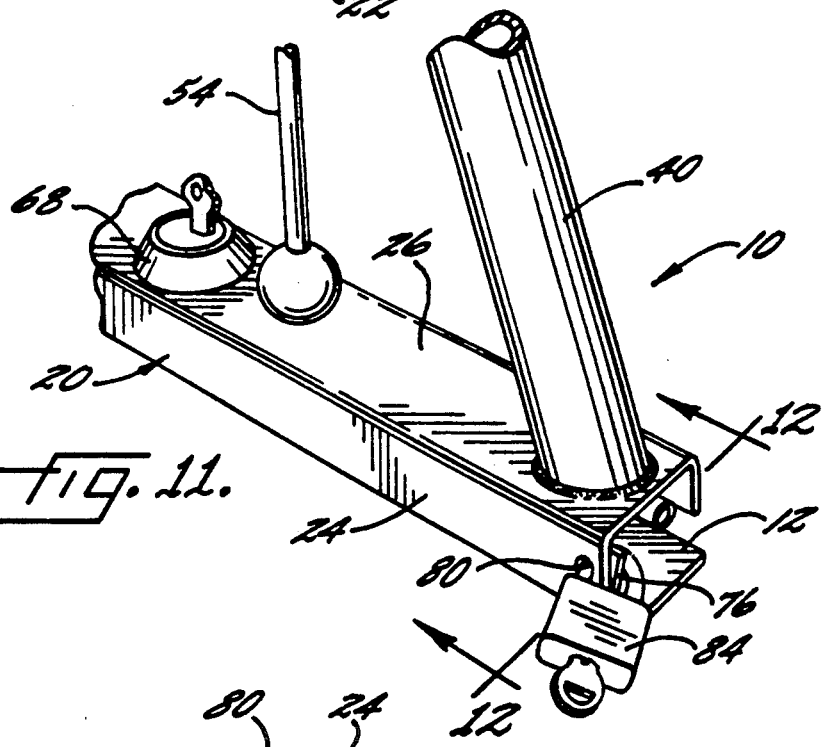
FIG. 11 is an isometric view of a portion of the barrier member and showing a padlock locking the carrying cover and the base member into the upright position.

A second upright locking member 76 is secured onto the base member and oriented longitudinal in the elongate direction. A hole so positioned in the carrying cover aligns with a hole 82 in the second upright locking member 76 when the carrying cover and barrier member are upright to allow a padlock 84 to be received therethrough (FIG. 11). The padlock provides additional security in addition to the deadbolt mechanism.

The parking barrier 10 of the present invention offers several benefits over other prior art parking barriers as described above. The locking mechanism 60 is substantially enclosed by the base member and carrying cover when the parking barrier is in a upright position. Thus, thieves have a reduced chance of successfully circumventing the locking mechanism. Additionally, the parking barrier is designed so that in a prone position, the vertical height is low and a vehicle may pass over the prone parking barrier without interference. Also, a parking barrier has other benefits such as means for allowing a padlock to be secured thereto. The barrier member configuration and construction also imparts strength and resists deformation as when a vehicle moves into the upright barrier member.

The foregoing embodiment is to be considered illustrative rather than restrictive of the invention, and the modifications that come within the range of equivalent to the claims are to be included therein.

That which is claimed is:

1. A parking barrier apparatus for restricting ingress into and egress from a parking space comprising an elongate, substantially planar base member having a top surface and adapted to be secured onto the ground of a parking space, an elongate, carrying cover pivotally connected to said planar base member and movable from a first, upright position in which the carrying cover substantially covers the top surface of the planar base member and into a second, prone position in which the carrying cover is pivoted away from the base member, said carrying cover including a channel portion of substantially U-channeled configuration and being inverted over a portion of the base member when the carrying cover is upright, a barrier member secured to the elongate carrying cover and extending outward therefrom, said barrier member extending vertically upward when the carrying cover is positioned in the first, upright position for preventing a vehicle from entering or exiting the parking space, and extending laterally with the base member and prone to the ground on which the base member is secured when the carrying cover is pivoted into the second position, and lock means secured within the channel of the carrying cover for selectively engaging and locking said cover in the first, raised position, wherein said lock means is substantially enclosed by said carrying cover and base member to prevent tampering to said lock means when the barrier is raised.

2. A parking barrier apparatus according to claim 1 wherein said barrier member comprises a tubular member of triangular configuration when looking transverse to the longitudinal direction of the base member for imparting strength and resisting deformation when a vehicle moves into the barrier member when upright.

3. A parking barrier apparatus according to claim 1 including clip means carried within the channel of said carrying cover for engaging said base member when said carrying cover is in an upright position for retaining said carrying cover and barrier member in an upright position.

4. A parking barrier apparatus according to claim 1 wherein said locking means is a deadbolt mechanism carried within the channel, and including an upright latch plate secured onto the base member that receives the bolt of the deadbolt mechanism when the carrying cover and barrier member are locked in an upright position.

5. A parking barrier apparatus according to claim 1 wherein said lock means includes a key opening positioned on the surface opposing the channel for allowing locking operation of the locking means.

6. A parking barrier apparatus according to claim 1 wherein said carrying cover includes end walls secured onto the end portions of the channel portion of the carrying cover for preventing access into the channel when the carrying cover is positioned in the upright position.

7. A parking barrier apparatus to claim 1 wherein said elongate carrying cover has opposing, substantially parallel legs and a top plate member interconnecting the top plate member and forming a U-shaped configuration, and wherein the legs are spaced no more than about three inches apart.

8. A parking barrier apparatus according to claim 1 wherein said barrier member comprises a tubular member of triangular configuration for imparting strength and resisting deformation when looking transverse to the longitudinal direction of the base member.

9. A parking barrier apparatus according to claim 1 including a spring clip carried within the channel of the carrying cover, and a clip receiving member secured onto the base member, and wherein the spring clip engages the clip receiving member when the carrying cover and barrier member are in an upright position.

10. A parking barrier apparatus for restricting ingress into and egress from a parking space comprising an elongate, substantially planar base member having a top surface, and adapted to be secured onto the ground of a parking space, an elongate, carrying cover having two elongate and substantially parallel leg members and an elongate, transverse top plate member interconnecting the two parallel leg members to form an elongate, box channel, and wherein one of the legs is pivotally connected to the base member so that the carrying cover is pivotably movable from a first, upright position in which the two leg members extend substantially perpendicular to the base member and the top plate member is positioned over the base member so that the top surface of the base member is substantially enclosed by the carrying cover to prevent access thereto, and a second prone position in which the carrying cover is pivoted away from the base member, a barrier member secured to the surface of the top plate member opposite the channel and extending outward therefrom substantially perpendicular thereto so that when the carrying channel is positioned within the first, upright position, the barrier member extends substantially vertically upward to prevent a vehicle from entering or exiting the parking space, and extends substantially lateral with the base member and substantially prone to the ground on which the base member is secured, and lock means secured within the channel of the carrying cover for selectively engaging and locking the cover in the first, raised position, wherein the lock means remains substantially enclosed by said carrying cover and base member to prevent tampering to the lock means when the barrier is raised and upright.

11. A parking barrier apparatus according to claim 8 wherein said lock means is a deadbolt mechanism secured within the channel between the two legs of the carrying cover, and including an upright latch plate secured onto the base member which receives the bolt of the deadbolt mechanism when the carrying cover and barrier member are locked in an upright position and the lock mechanism is actuated.

12. A parking barrier apparatus according to claim 10 wherein said locking means includes a key opening positioned on the surface opposing the channel for allowing locking operation of the locking means when the carrying channel is positioned in the upright position.

13. A parking barrier apparatus according to claim 10 wherein the legs of the carrying cover are spaced from each other no greater than about four inches.

14. A parking barrier apparatus according to claim 10 wherein the height of the legs when in an upright position is no greater than about three inches.

15. A parking barrier apparatus according to claim 10 wherein the carrying cover includes end walls secured to the end portions of the carrying cover for preventing access into the channel when the carrying cover is in an upright position.

16. A parking barrier apparatus according to claim 10 wherein the barrier member includes a lifting rod for facilitating the manual raising of the barrier member.

17. A parking barrier apparatus according to claim 10 wherein said carrying cover and base member include means for receiving a padlock therethrough.

* * * * *

UNITED STATES PATENT AND TRADEMARK OFFICE

CERTIFICATE OF CORRECTION

PATENT NO. : 5,167,093

DATED : December 1, 1992

INVENTOR(S) : Hamilton

It is certified that error appears in the above-identified patent and that said Letters Patent is hereby corrected as shown below:

Column 3, line 28, after "vehicle" v should --V--.

Column 4, line 64 after "hole" so should be --80--.

Column 7, line 1, after "claim" 8 should be --10--.

Signed and Sealed this

Twenty-sixth Day of October, 1993

*Attest:*

Bruce Lehman

BRUCE LEHMAN

*Attesting Officer*

*Commissioner of Patents and Trademarks*